US010836572B2

(12) United States Patent
Derderian

(10) Patent No.: US 10,836,572 B2
(45) Date of Patent: Nov. 17, 2020

(54) ORGANIC WASTE RECYCLING CONTAINER MODULE AND METHOD

(71) Applicant: Abacus Global Holdings, Inc, San Diego, CA (US)

(72) Inventor: Armen David Derderian, San Diego, CA (US)

(73) Assignee: PreZero US Services, LLC, San Diego, CA (US)

( * ) Notice: Subject to any disclaimer, the term of this patent is extended or adjusted under 35 U.S.C. 154(b) by 0 days.

(21) Appl. No.: 15/910,859

(22) Filed: Mar. 2, 2018

(65) Prior Publication Data

US 2020/0062498 A1 Feb. 27, 2020

Related U.S. Application Data

(63) Continuation-in-part of application No. 15/278,319, filed on Sep. 28, 2016, now abandoned.

(51) Int. Cl.
*B65F 1/00* (2006.01)
*B65F 1/14* (2006.01)

(52) U.S. Cl.
CPC ..... *B65F 1/006* (2013.01); *B65F 1/1426* (2013.01); *B65F 1/1473* (2013.01); *B65F 2001/1489* (2013.01); *B65F 2220/101* (2013.01); *B65F 2220/124* (2013.01)

(58) Field of Classification Search
CPC ..... B65F 1/006; B65F 1/1426; B65F 1/1473; B65F 2001/1489; B65F 2220/101; B65F 2220/124; B65D 19/16; B65D 19/12; B65D 88/52; B65D 88/524; B65D 88/00
USPC ..... 206/600, 596, 386; 220/23.88, 1.5
See application file for complete search history.

(56) References Cited

U.S. PATENT DOCUMENTS 4,214,669 A * 7/1980 McQuiston ..... B65D 88/524 220/1.5
4,684,034 A * 8/1987 Ono ..... B65D 7/24 220/1.5
5,056,667 A * 10/1991 Coogan ..... B65D 19/12 206/600
5,704,476 A * 1/1998 Abbott ..... B65D 90/24 108/55.3
5,762,222 A * 6/1998 Liu ..... B65D 19/12 206/512
5,890,612 A * 4/1999 Coppi ..... B65D 88/524 206/600
6,044,998 A * 4/2000 Schearer ..... B65D 19/18 206/600
9,718,611 B2 * 8/2017 Rio Gonzalez .... B65D 90/0006
(Continued)

*Primary Examiner* — Steven A. Reynolds

(57) ABSTRACT

A receptacle storage unit, or bin has surfaces for retaining four smaller waste receptacles, or carts therein. The receptacle storage unit is formed on a pallet base with three lateral sides, and an open front through which the receptacles are removed and replaced once full. The receptacle storage unit includes two opposing walls between which two receptacles are held. At the top of the receptacles, they are held by surfaces on the opposite edges of the handle against the walls. At the bottom of the receptacles, the receptacles are held by edges at the outside of the wheels. In a central part of the receptacle, a frame of the receptacle storage unit holds the central part of the receptacle. The receptacle storage unit has surfaces and flanges enabling multiple units to be stacked on top of one another.

7 Claims, 10 Drawing Sheets

(56) References Cited

U.S. PATENT DOCUMENTS

| | | | | |
|---|---|---|---|---|
| 9,815,587 | B2 * | 11/2017 | Matsuoka | B65D 65/403 |
| 2015/0021229 | A1 * | 1/2015 | Lundius | B65D 19/06<br>206/600 |

* cited by examiner

ORGANIC WASTE RECYCLING CONTAINER MODULE AND METHOD

This is a continuation-in-part of Ser. No. 15/278,319, filed Sep. 28, 2016.

The present application describes a container for facilitating the recycling of organic waste, in a way which is convenient to the user, easy to use, and user-friendly.

BACKGROUND

The state of California has mandated in AB 1826, that commercial businesses that generate organic waste must recycle it. The law is currently in place for larger generators, however, beginning in 2019, all commercial businesses that generate 4 or more cubic yards of solid waste per week must arrange for organic waste recycling. Other states and municipalities have passed and/or are considering passing similar laws mandating recycling of organics.

In addition, food waste is actually an underutilized resource, since certain kinds of food waste can be used as animal feed, and can also be used for compost, energy production, and other products. Rather than taking up space in a landfill, recycled food and organic waste can actually be re-used if properly segregated from other waste.

The inventors of the present invention realized that other kinds of organic recycling programs have not been successful, at least partly because of the inconvenience associated with cleaning containers that once held food waste and other biodegradable organic materials.

SUMMARY OF THE INVENTION

The inventor found that users do not want to use dirty and smelly containers for the organic recycling. So they do not want to open a container that has been used for days that contains decomposing food waste and other organic materials.

The present application describes a system which includes multiple different relatively small size organic recycling carts. These organic recycling carts are held together in a container or bin. Each of the recycling carts is itself very small, according to one embodiment the recycling cart can be a 32-gallon waste receptacles, where four of the waste receptacles are held within a larger receptacle storage container. The receptacle storage container includes structure for holding the smaller carts into place, and also includes structure enabling the super container or bin to be handled with a forklift.

In a particular embodiment, four 32-gallon waste carts are held within one receptacle storage unit or bin. The customers wheel one waste cart to their workstation at a time, fill the waste cart with organics, and then close the waste cart with a special closing mechanism.

The waste cart, filled with organic material (or in other embodiments, with other recyclable or trash) is put back in the receptacle storage. Once filled, the waste carts can be removed, emptied, and sanitized, and then the container with the waste carts thereon can be returned to be refilled with organic waste.

In an embodiment, the larger receptacle storage units or bins are three sided containers, with structure on three sides for holding the waste carts. The fourth side is open, but includes holding structures which hold the smaller wheeled waste carts into place.

DETAILED DESCRIPTION

An embodiment is described herein for recycling organic matter. However, it should be understood that other embodiments which are similar can be used for recycling other materials.

This application is described with reference to the embodiments described herein, which are not intended to limit the scope of the present invention which is in fact defined by the claims.

Figure 1:
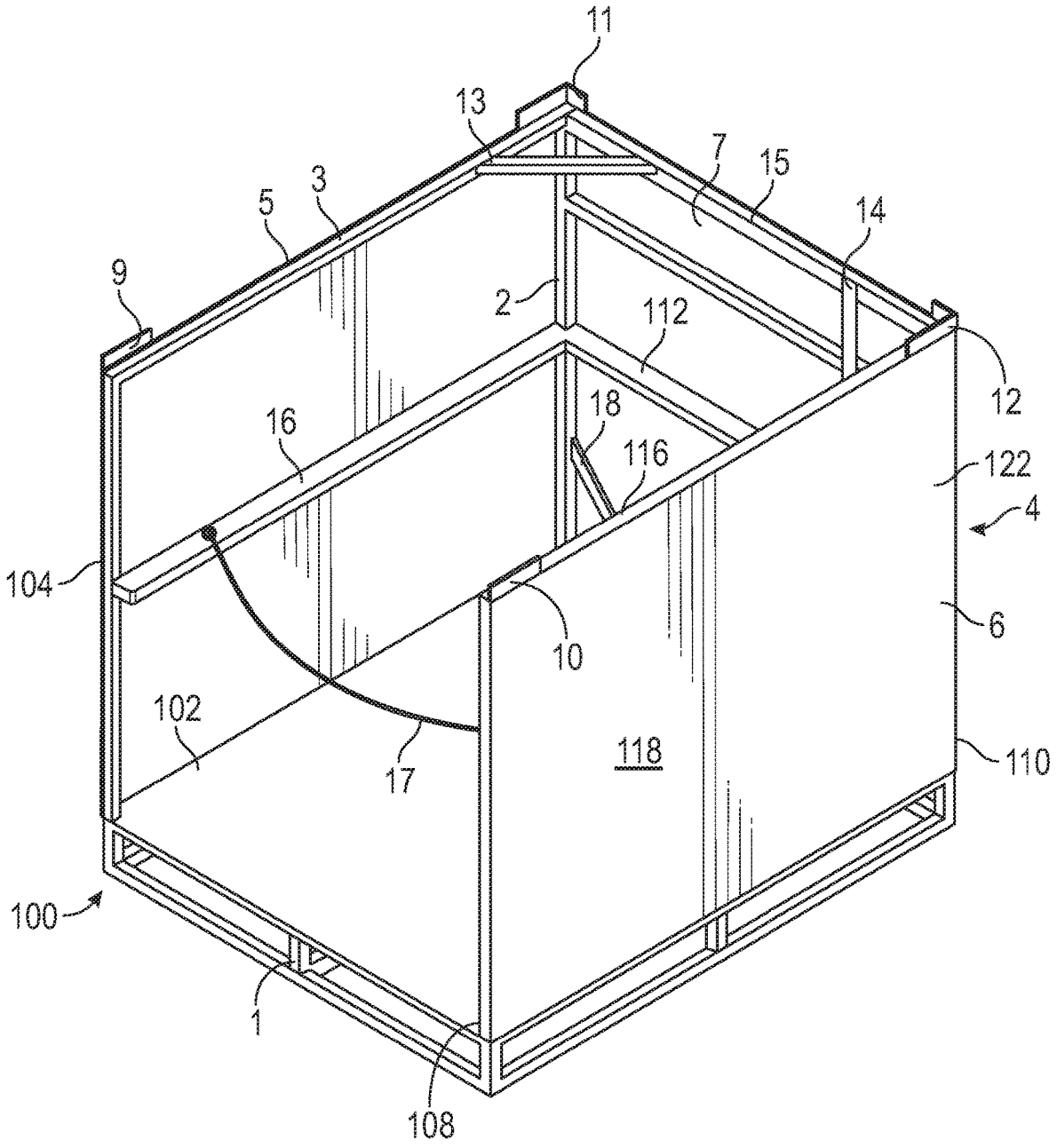
FIG. 1 is a front top perspective view of an embodiment of the receptacle storage unit.
Figure 9:
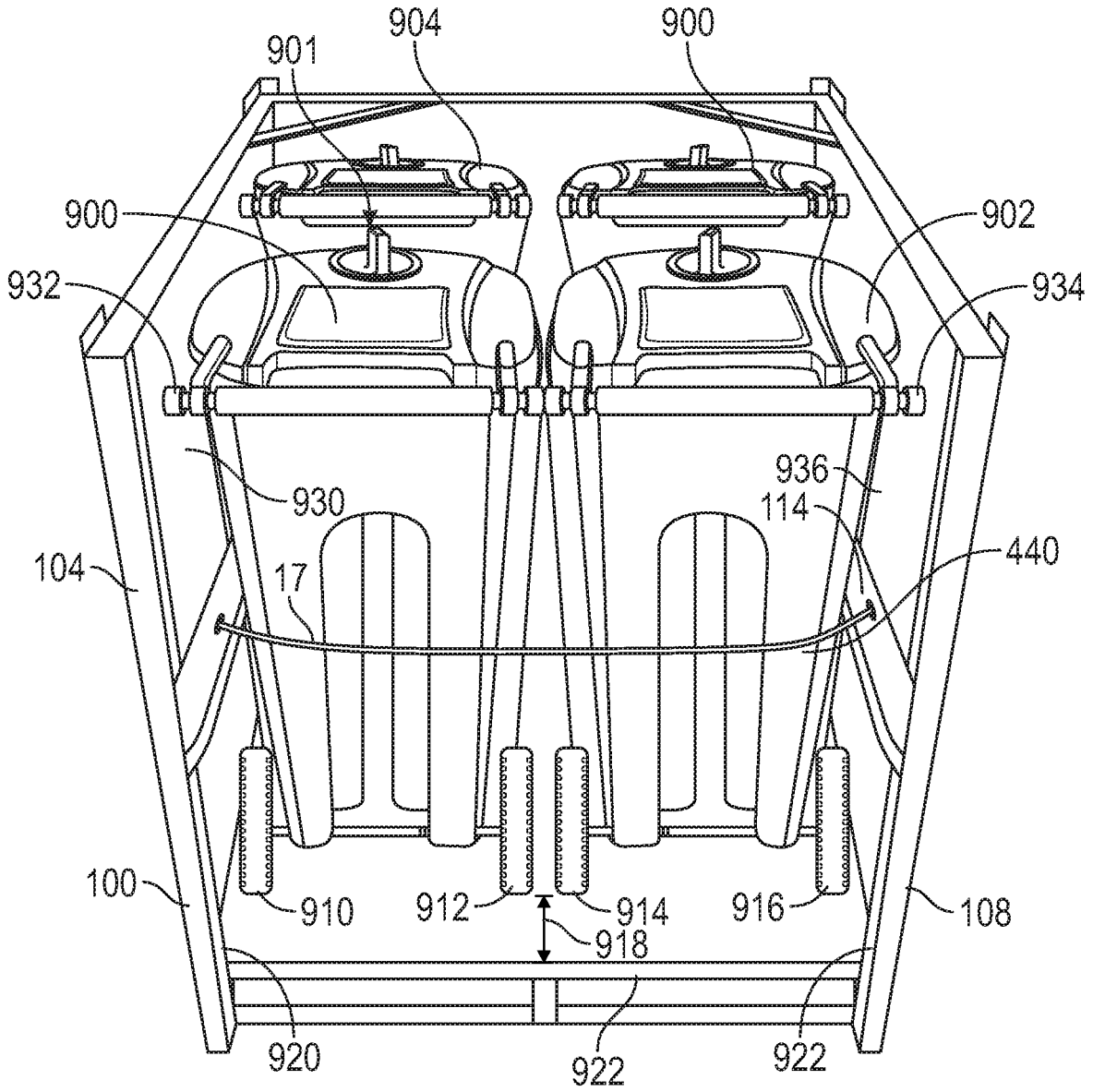
FIG. 9 shows the receptacle storage unit with four waste carts located therein, and shows the sizing of the receptacles from a front-on view.
Figure 10:
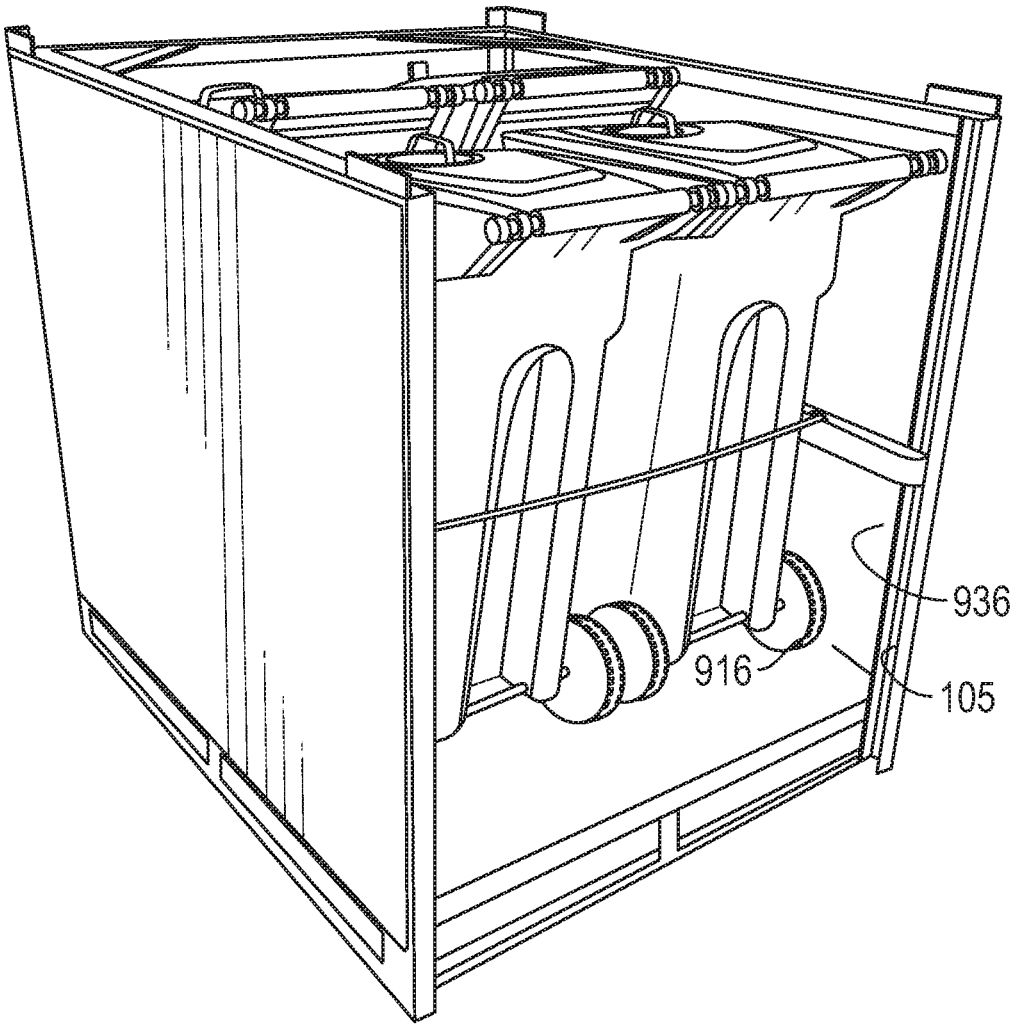
FIG. 10 shows the receptacle storage unit with four waste carts located therein and shows the sizing of the carts from a side view.

A waste receptacle container 100 is shown in FIG. 1. This container 100 is sized to hold four smaller containers, or carts (as shown in FIGS. 9 and 10). In this embodiment, the four smaller carts are of a 32 gallon size; however other size containers can analogously be used.

Views of the embodiment shown in FIGS. 1-8 show how the device is formed of a pallet base 1, a container frame 2, and lateral walls 4, 6,7, retained by the supports. The pallet base 1 enables the waste receptacle 100 to be lifted and transported via a forklift or pallet jack. The pallet base 1 additionally serves as a base for the waste receptacle 100. In the preferred embodiment of the waste receptacle 100, the pallet base 1 is a four-way entry pallet, allowing the waste receptacle 100 to be lifted from all four sides of the pallet base 1. The container frame 2 provides structure to the waste receptacle 100 and serves as a mounting point for the lateral walls. The container frame 2 is connected about the perimeter of the pallet base, providing a foundation onto which the lateral walls are mounted. The lateral walls hold and restrain waste receptacles within the waste receptacle 100 when the waste receptacle 100 is in use. The lateral walls include a first wall panel 5, a second wall panel 6, and a third wall panel 7. In the preferred embodiment of the waste receptacle 100, an open end is present through which waste receptacles may be placed within the lateral walls. Additionally, the top of the waste receptacle 100 remains open.

The pallet base 1 is covered with a solid floor 102 of steel or some other rigid material. In one embodiment, this can be formed of flat sheet steel, welded to the pallet base 1.

The pallet base 1 attaches to container frame 2 which provides structure to the outer holding portion of the frame. The frame 2 is formed of a number of different vertically extending members extending from the pallet floor to the frame top, and a number of vertical members, extending vertically and providing structural support. The frame also includes diagonal frame parts, as described herein.

The first wall panel 5, the second wall panel 6, and the third wall panel 7 form three walled sections on the pallet base 1. The first wall panel 5 and the second wall panel 6 are oriented parallel to each other and are positioned on the left side and the right side of the pallet base 1. The third wall panel 7 is terminally connected to the first wall panel 5 and the second wall panel 6 and as such is connected in between the first wall panel 5 and the second wall panel 6. The third wall panel 7 is oriented perpendicular to the first wall panel 5 and the second wall panel 6. In an embodiment, the third wall panel 7 is thus positioned on the rear side of the pallet base 1. The front side is left open to allow waste carts to be positioned inside.

These walls are retained by the frame. The frame is formed of vertical members 104, 106, 108 and 110 forming edges of the frame. The horizontal members extend between these vertical members, with a horizontal member 16 extending between the vertical members 104 and 106, horizontal member 112 extending between the members 106 and 110, and another horizontal member 114 extending between the members 110 and 108. Similarly, there are top horizontal members 3, 115, 116 extending across the top of the storage receptacle. The top horizontal members are braced by bracing elements 13, 14.

The support members are covered by the lateral wall members 5,6,7 that are connected to the container frame providing both lateral support and also providing a surface such as 118 on which advertising or the like can be placed.

A plurality of retaining flanges are provided to enable multiple instances of the waste receptacle 100 to be stacked on top of each other. The plurality of retaining flanges are distributed about an upper edge 3 of the container frame. The purpose of the flanges is to prevent a second waste receptacle stacked on top of the first waste receptacle 100 from shifting or becoming unstable when stacked on top of the waste receptacle 100.

The retaining flanges include a first planar flange 9 and a second planar flange 10. The first planar flange 9 and the second planar flange 10 are used to brace the first wall panel 5 and the second wall panel 6 of the waste receptacle 100 when the second waste receptacle is stacked on top of the waste receptacle 100.

The first planar flange 9 is connected to the upper edge 3 of the container frame 2, adjacent to the first wall panel 5, and the second planar flange 10 is connected to the upper edge 3 of the container frame 2, adjacent to the second wall panel 6. The first planar flange 9 and the second planar 30 flange 10 are thus able to prevent the second waste receptacle 100 from moving laterally and falling off of the first wall panel 5 and the second wall panel 6. The first planar flange 9 and the second planar flange 10 are positioned opposite to the third wall panel 7, providing two points of stabilization positioned away from the third wall panel 7.

The plurality of retaining flanges further comprises a first angular flange 11 and a second angular flange 12. The first angular flange 11 and the second angular flange 12 are used to brace the first wall panel 5 and the third wall panel 7 as well as the second wall panel 6 and the third wall panel 7 of a second instance of the waste receptacle 100 when the second waste receptacle 100 is stacked on top of the waste receptacle 100. The first angular flange 11 is connected to the upper edge 3 of the container frame 2, adjacent to the first wall panel 5 and the third wall panel 7, while the second angular 10 flange 12 is connected to the upper edge 3 of the container frame 2, adjacent to the second wall panel 6 and the third wall panel 7. The first angular flange 11 and the second angular flange 12 are thus able to prevent the second waste receptacle 100 from falling off of the third wall panel 7. The flanges 11 and 12 are at substantially right angles with one another, thus preventing the unit from moving either laterally or towards the rear. The first angular flange 11 and the second angular flange 12 provide two additional points of stabilization in addition to those provided by the first planar flange 9 and the second planar flange 10.

The waste receptacle 100 further comprises a first support gusset 13 and a second support gusset 14. The first support gusset 13 and the second support gusset 14 provide structural support to the container frame 2 by bracing the corners near the flanges 11 and 12. The first support gusset 13 is terminally connected to the container frame 2, adjacent to the first wall panel 5 and the third wall 20 panel 7, while the second support gusset 14 is terminally connected to the container frame 2, adjacent to the second wall panel 6 and the third wall panel 7. The first support gusset 13 and the second support gusset 14 thus provide improved structural support to the container frame 2 in the horizontal plane, especially when the second waste receptacle is stacked on top of the waste receptacle 100.

In an embodiment, the first support gusset 13 and the second support gusset 14 are oriented parallel to the pallet base 1. The first support gusset 13 and the second support gusset 14 are thus positioned and oriented in a manner such that waste receptacles may be positioned within the waste receptacle 100 without interference. The second waste receptacle may additionally be stacked on top of the waste receptacle 100 without interference by the first support gusset 13 and the second support gusset 14.

FIGS. 2 through 8 illustrate alternate views of the empty waste receptacle 100.

Figure 2:
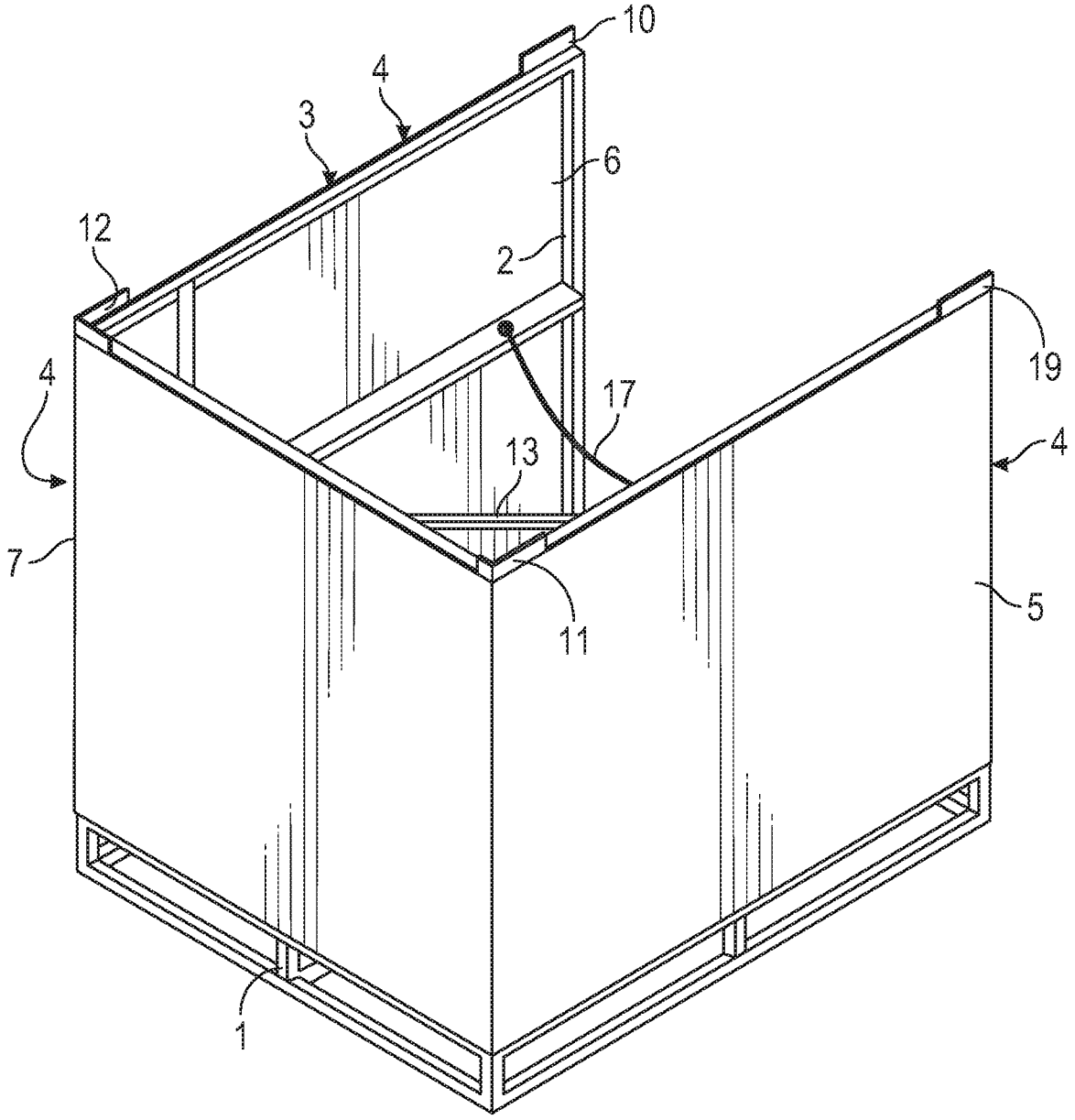
FIG. 2 is a rear top perspective view of an embodiment of the receptacle storage unit present invention.

FIG. 2 illustrates the waste receptacle from the rear, showing the walls 5 and 7, which have a similar structure to that in shown in FIG. 1 for the wall 6.

Figure 3:
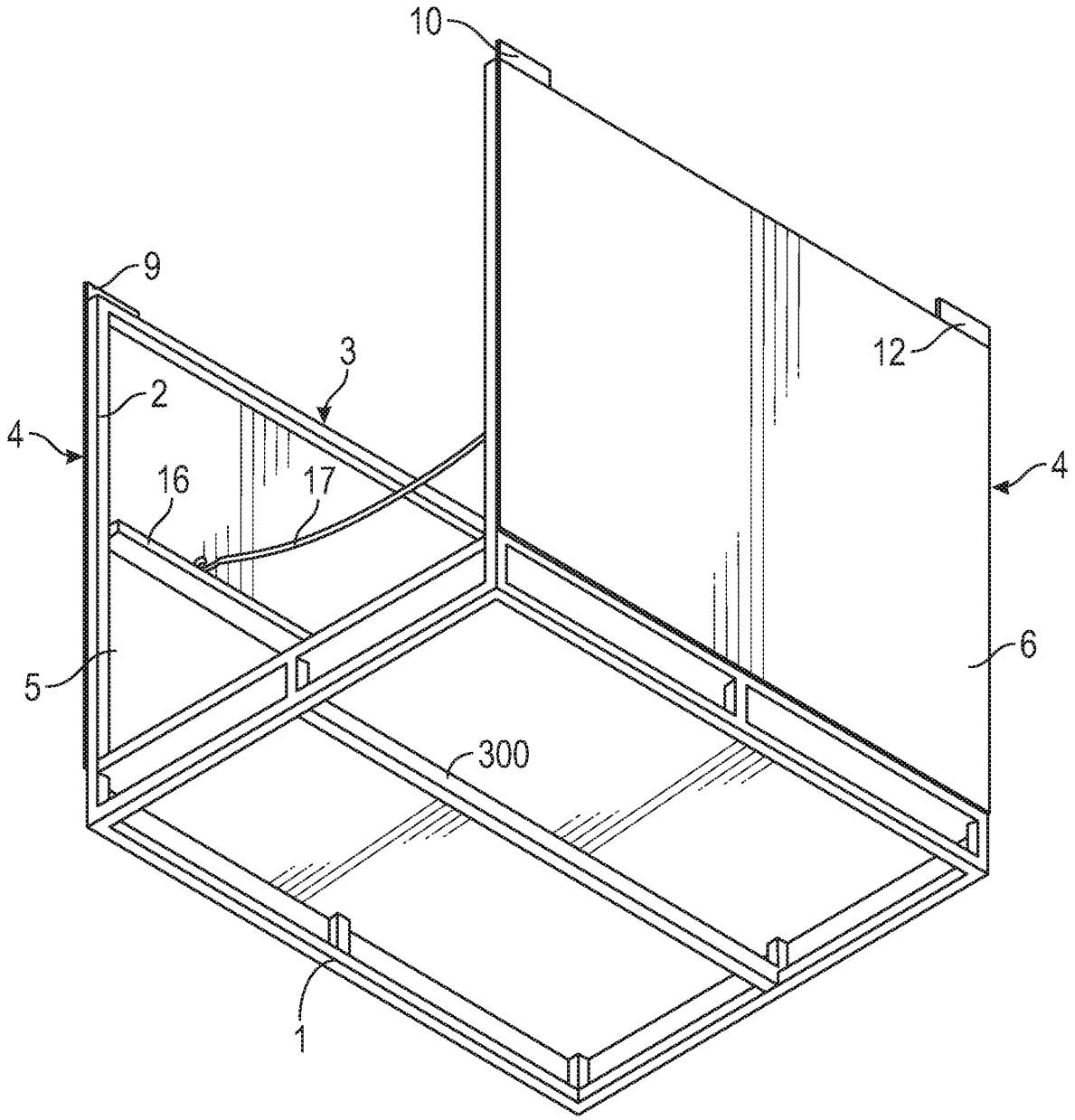
FIG. 3 is a front bottom perspective view of the embodiment of the receptacle storage unit.
Figure 4:
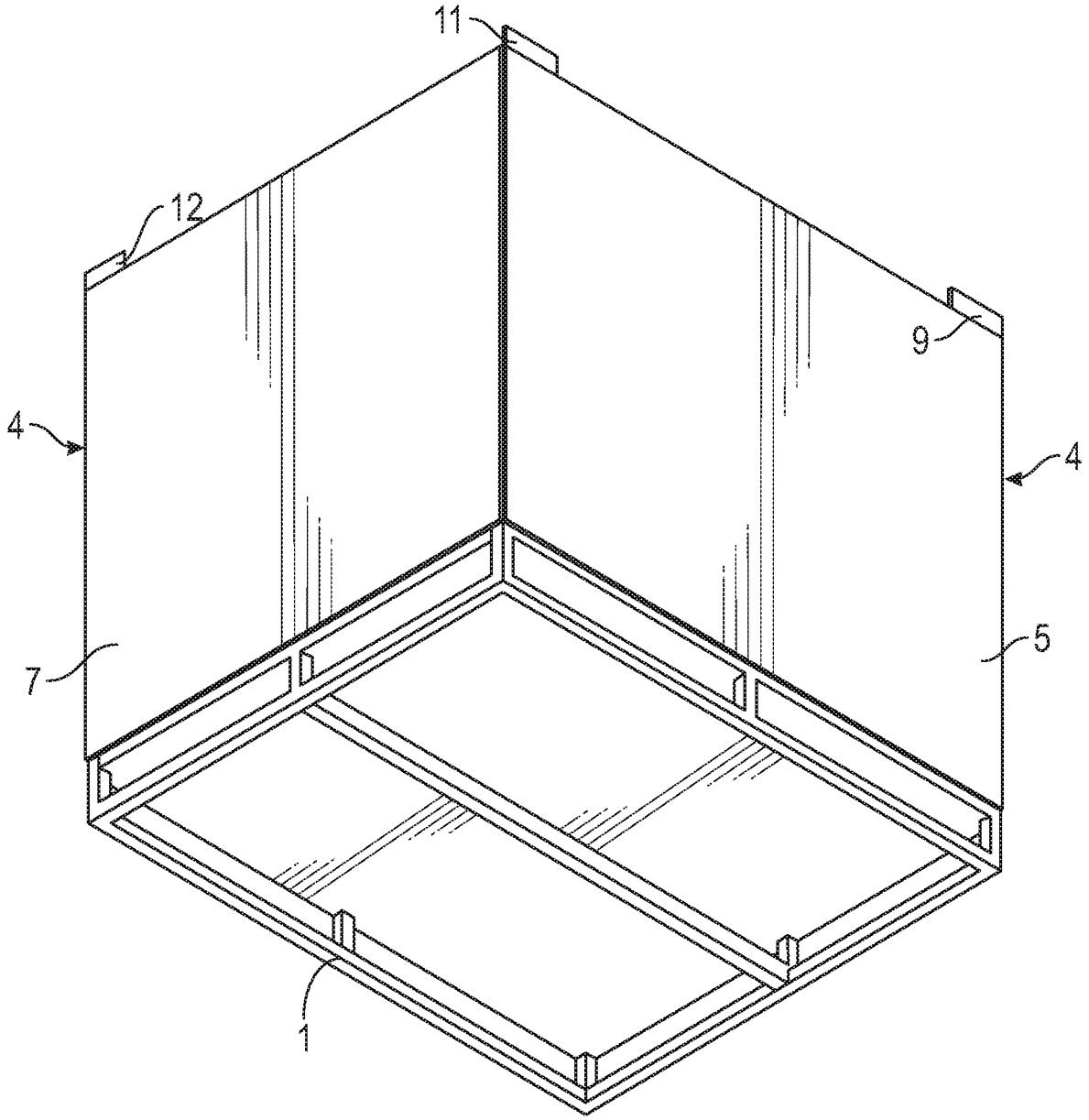
FIG. 4 is a rear bottom perspective view of the embodiment of the receptacle storage unit.

FIG. 3 shows a bottom perspective view, showing the structure of the pallet base 1. As seen in FIG. 3, the pallet base 1 includes a support member 300 running across the bottom of the pallet base one to maintain the structural integrity. FIG. 4 shows the bottom perspective view from the opposite side, showing the walls 5 and 7.

Figure 5:
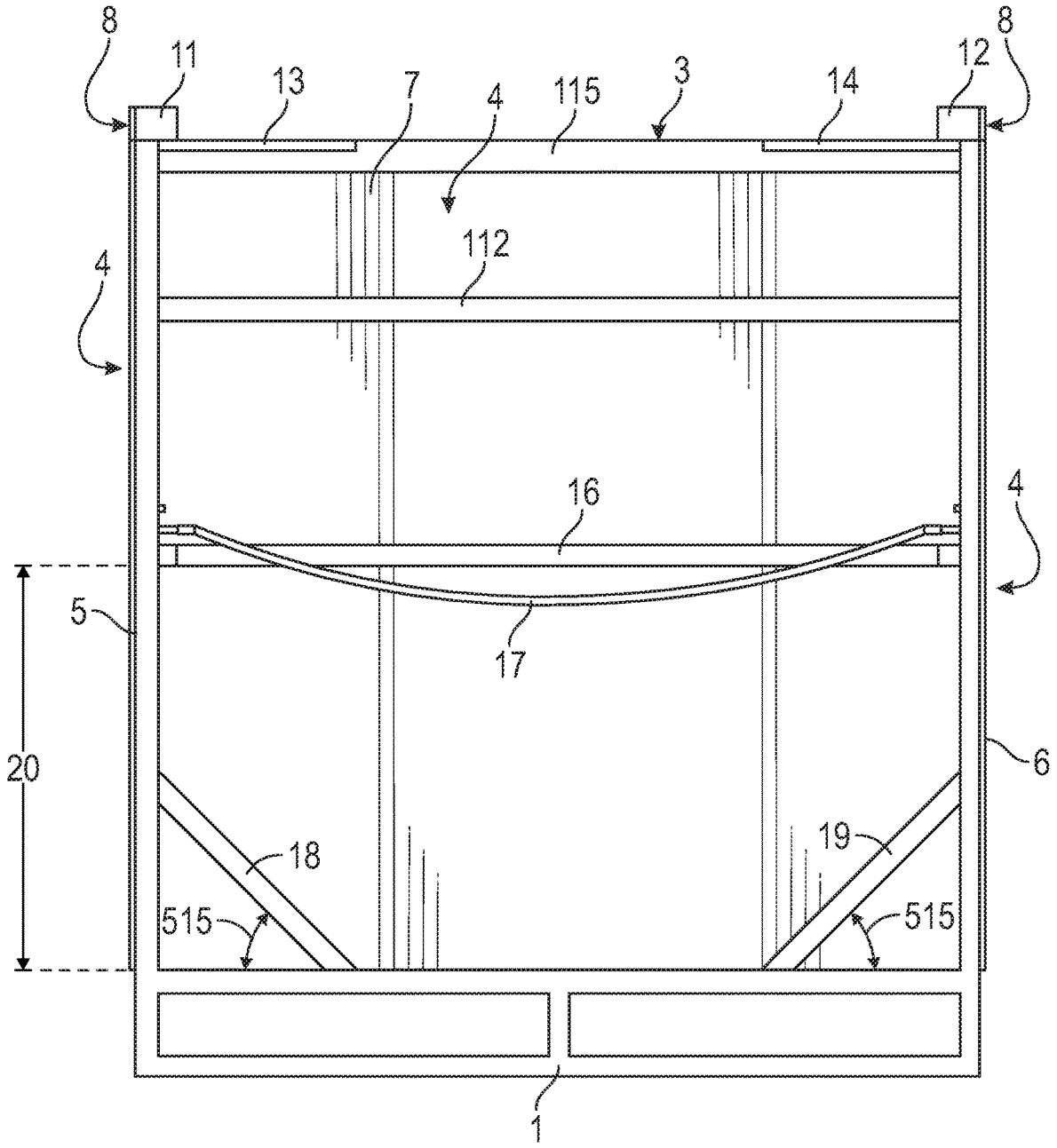
FIG. 5 is a front view of the embodiment of the receptacle storage unit.

FIG. 5 shows a view from the front, showing the retaining strap 17, and showing in the background, the supports 112, and 115.

Figure 6:
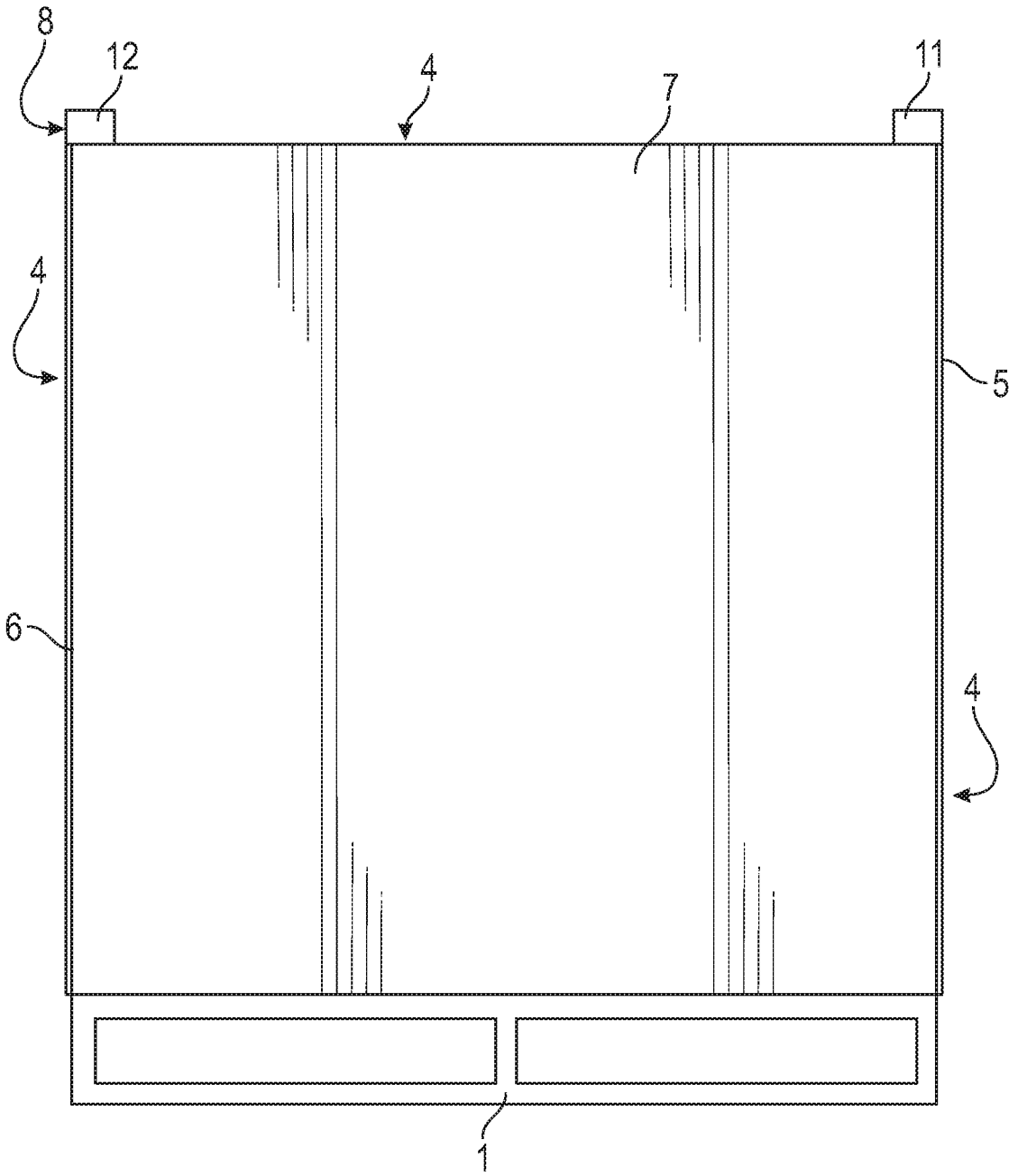
FIG. 6 is a rear view of the embodiment of the receptacle storage unit.

FIG. 6 shows the rear perspective view, showing the structure referred to in the previous embodiments.

Figure 7:
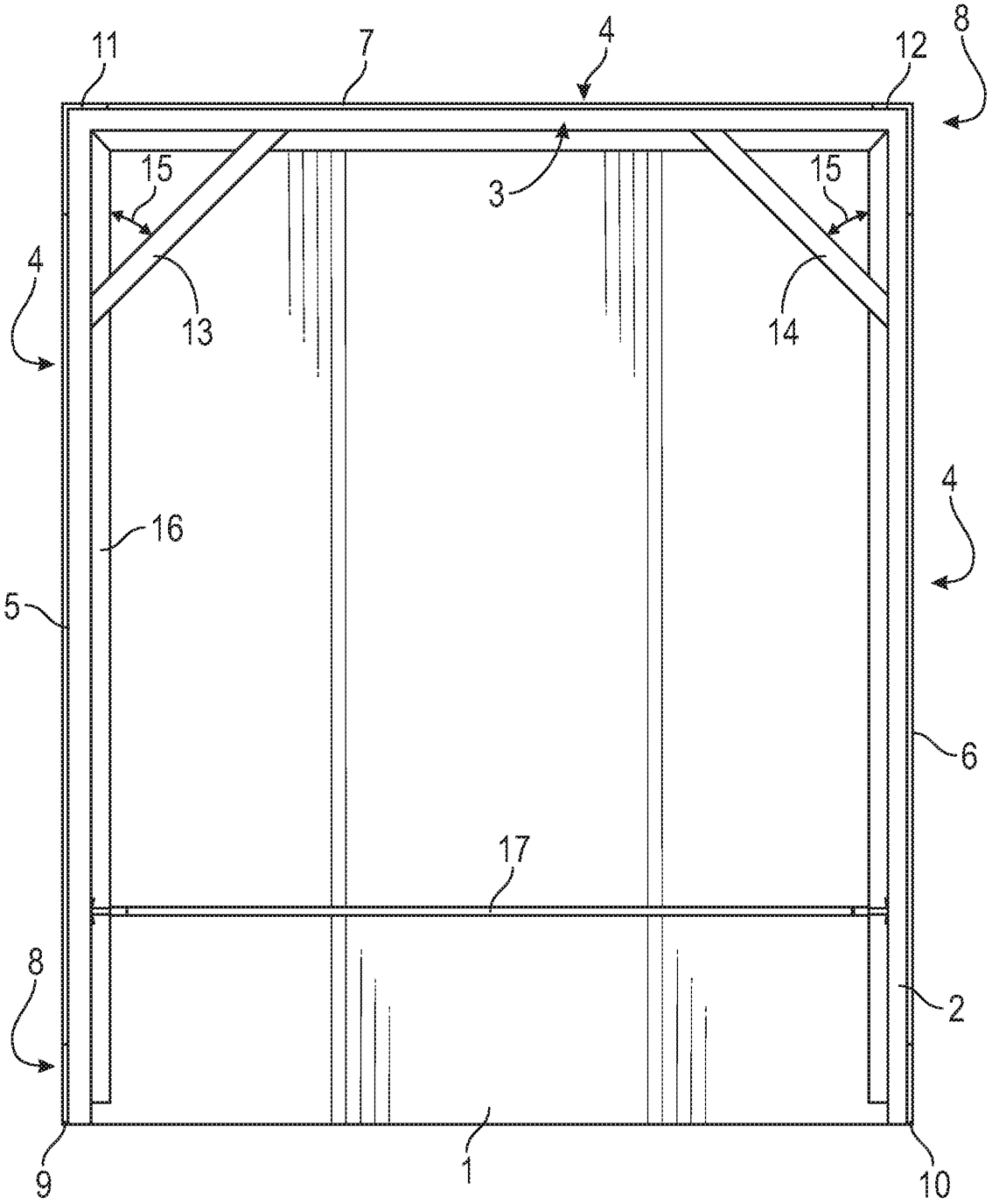
FIG. 7 is a top view of the an embodiment of the receptacle storage unit.
Figure 8:
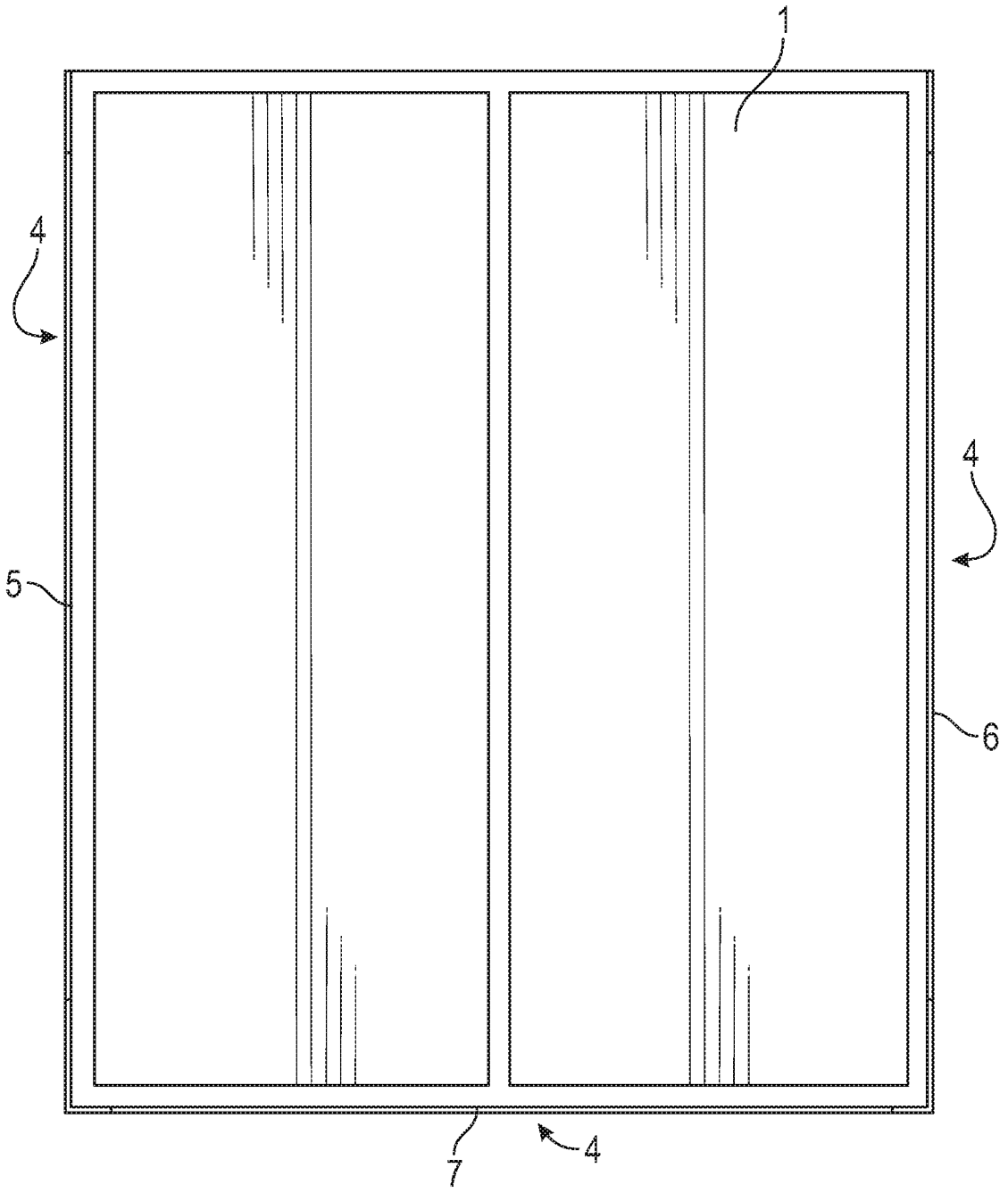
FIG. 8 is a bottom view of the embodiment of the receptacle storage unit.

FIG. 7 shows a top view, showing the first support gusset 13 and the first wall panel 5 are oriented at a specified angle 15 to each other. In one embodiment, the angle 15 is 45 degrees. Similarly, the second support gusset 14 and the second wall panel 6 are oriented at a specified angle 15 to each other. The angled orientation of the first support gusset 13 and the second support gusset 14 allows the first support gusset 13 and the second support gusset 14 to be positioned in the corners formed by the first wall panel 5 and the third wall panel 7 as well as the second wall panel 6 and the third wall panel 7.

The waste receptacle 100 further comprises a third support gusset 18 and a fourth support gusset 19 that function in a similar manner as the first support gusset 13 and the second support gusset 14. The third support gusset 18 and the fourth support gusset 19 provide additional structural support to the container frame 2. The third support gusset 18 is terminally connected to the container frame 2, adjacent to the third wall panel 7, while the fourth support gusset 19 is terminally connected to the container frame 2, opposite to the third support gusset 18 across the third wall panel 7. The third support gusset 18 and the fourth support gusset 19 thus provide improved structural support to the container frame 2 in the vertical plane when a second waste receptacle is stacked on top of the waste receptacle 100.

In another preferred embodiment of the waste receptacle 100, the third support gusset 18 and the fourth support gusset 19 are oriented perpendicular to the pallet base and are thus positioned and oriented in a manner such that the third support gusset 18 and the fourth support gusset 19 do not hinder the placement of waste receptacles within the waste receptacle 100. As shown in FIG. 5, the third support gusset 18 and the pallet base are oriented at a specified angle 515 to each other. Similarly, the fourth support gusset 19 and the pallet base 1 are oriented at a specified angle 515 to each other. The angled orientation of the third support gusset 18 and the fourth support gusset 19 allows the third support gusset 18 and the fourth support gusset 19 to provide improved structural support for the container frame 2 adjacent to the 25 pallet base 1.

The waste receptacle 100 further comprises a restraining rail 16. The restraining rail 16 is used to ensure that waste receptacles within the waste receptacle 100 remain snug and do not shift or otherwise move during use of the waste receptacle 100. The restraining rail 16 traverses about the container frame 2, adjacent to the first wall panel 5, the second 30 wall panel 6, and the third wall panel 7. The restraining rail 16 is thus placed into contact with the sides of the waste receptacles within the waste receptacle 100 and ensures that the waste receptacles are snug within the lateral wall 4. In the preferred embodiment of the waste receptacle 100, the restraining rail 16 is oriented parallel to the pallet base 1 and as such remains level across the interior surface. As shown in FIG. 5, the restraining rail 16 is offset from the pallet base 1 by a specified distance 20 to accommodate the tapered design of conventional waste receptacles. The specified distance 20 sufficiently offsets the restraining rail 16 from the pallet base 1 to allow the restraining rail 16 to be placed into contact with the sides of the waste receptacles.

The waste receptacle 100 further comprises a restraining cable 17 that is utilized to prevent waste carts within the waste receptacle 100 from being displaced or falling out of the waste receptacle 100 through the open end. The restraining cable 17 along with the restraining rail 16 ensure that the waste receptacles remain snug within the waste receptacle 100. The restraining cable 17 is removably connected in between the first wall panel 5 and the second wall panel 6, opposite to the third wall panel 7. The restraining cable 17 is thus positioned across the open end of the waste receptacle 100, preventing movement of the waste carts within. The restraining cable 17 may be removed in order to load waste carts into the waste receptacle 100 or when removing waste carts from the waste receptacle 100. Although the waste receptacle 100 has been explained in relation to its preferred embodiment, it is understood that many other possible modifications and variations can 20 be made without departing from the spirit and scope of the waste receptacle 100 as hereinafter claimed.

FIG. 9 shows how the container 100 in operation stores four separate waste carts in a secure but removable fashion. The four waste carts are shown in FIG. 9 as 900, 902, 904 and 906. Two waste carts are sized to fit snugly within the side to side lateral confines of the storage container. The waste carts such as 900 are each wheeled receptacles. A first wheel 912 defines the outer extent of the waste receptacles. When the receptacles are placed within the container, the wheel 914 of the second receptacle 902 abuts directly against the adjoining wheel 912 of the first waste receptacle 900. The second wheel 916 and the first wheel 910 of the first receptacle press against the inner surface of the outer walls of the storage container. The two waste receptacle wheels thus press against the outer walls, but the distance between the wheels 910 and 916 is less than the distance between the inner surface 920 of the first support 104 and the inner surface 922 of the second support 108. In this way, the locations of the supports further retain the storage receptacles, or carts into place. In addition, the straps 17 also hold the carts into place. When all four carts are placed into the receptacle holder, they are further held in place by the supports pressing against outer surfaces of the receptacles. Specifically, the bottom wheels 910 press against inner surface 920 of the sidewall 104. The bottom wheel 914 presses against the inner surface 922 of the sidewall 108. Similarly, the handle edges 932 and 934 also may press against those inner surfaces. Therefore, these devices are even more securely held into place when all trash bins are positioned in place.

The receptacles, or carts can also be removed from the container by removing the straps 17, and pulling the receptacle such as 900 towards the opening, far enough that the wheel 912 can pass behind the wheel 914. That is, when the trash receptacles are fully into place, there is enough room shown as space 918 between the rear surface of the wheel, and the edge surface 922 of the pallet, to allow the trash receptacle 900 to be pulled back, twisted slightly so that the wheel 912 moved to the right in FIG. 9 and the wheel 910 can move away from the wall far enough to pass the support 920. Then, this receptacle can be removed.

Once removed, the receptacle is filled, sealed using the sealing mechanism 901, and replaced into the receptacle, preferably in the rear portion of the receptacle, so that the front-most containers remain empty.

FIG. 10 shows a side on view of the filled container, showing the wheel 916 abutting directly against the inner surface 936, and blocked by the protruding support 108.

Notice also in FIG. 9, that the two portions where the container is laterally widest are at the handle 934 and the wheel 916. The center portion such as 940 is narrow enough so that it can fit inside the support 114.

While the preferred embodiments have been shown and described, it will be understood that there is no intent to limit the invention by such disclosure, but rather, is intended to cover all modifications and alternate constructions falling within the spirit and scope of the invention.

Although only a few embodiments have been disclosed in detail above, other embodiments are possible and the inventors intend these to be encompassed within this specification. The specification describes certain technological solutions to solve the technical problems that are described expressly and inherently in this application. This disclosure describes embodiments, and the claims are intended to cover any modification or alternative or generalization of these embodiments, which might be predictable to a person having ordinary skill in the art. For example, other sizes of containers could be used, and could be used for other kinds of recycling.

Also, the inventor(s) intend that only those claims which use may press against the inner surface the words "means for" are intended to be interpreted under 35 USC 112, sixth paragraph. Moreover, no limitations from the specification are intended to be read into any claims, unless those limitations are expressly included in the claims.

Where a specific numerical value is mentioned herein, it should be considered that the value might be increased or decreased by any amount, so long as it maintains the integrity of the hook 100, while still staying within the teachings of the present application, unless some different range is specifically mentioned. The previous description of the disclosed exemplary embodiments is provided to enable any person skilled in the art to make or use the waste receptacle 100. Various modifications to these exemplary embodiments will be readily apparent to those skilled in the art, and the generic principles defined herein may be applied to other embodiments without departing from the spirit or scope of the invention. Thus, the waste receptacle 100 is not intended to be limited to the embodiments shown herein but is to be accorded the widest scope consistent with the principles and novel features disclosed herein.

What is claimed is:

1. A receptacle storage system, comprising:

a receptacle storage unit, having a floor, a first side wall and a second side wall opposing said first side wall, the second side wall being substantially parallel to said first side wall, each of said first and second side walls including a top and a bottom portion, the bottom portion adjoining the floor, and a third side wall extending between said first and second side walls, and including a top portion and a bottom portion, the bottom portion of the third side wall attached to the floor;

said first side wall including:

a first surface forming an inside surface of the first side wall, a first horizontal member, extending inward toward the second side wall, and extending more toward the second side wall than the first surface, the first horizontal member located at substantially a center portion of the first side wall between the top of the first side wall and the bottom portion of the first side wall, and a first vertical member extending perpendicular to said first horizontal member, at a front of the first side wall, and defining a front edge of the first side wall, where the first vertical member extends inward by a distance towards the second side wall; and said second side wall including:

a first surface forming an inside surface of the second side wall, a second horizontal member, extending inward toward the first side wall, and extending more toward the first side wall than the first surface, the second horizontal member located at substantially a center portion of the second side wall between the top of the second side wall and the bottom portion of the second side wall, and a second vertical member, extending perpendicular to said second horizontal member, at the front of the second side wall, and defining a front edge of the second side wall, where the second vertical member extending inward by a distance towards the first side wall, further comprising first, second, third and fourth waste receptacles each having wheels at a bottom portion, and each having a handle at a top portion, where inside surfaces of the receptacle storage unit are sized to hold said first, second, third and fourth waste receptacles, and wherein the first and second waste receptacles fit side to side between the first and second side walls, and where edges of the handles of the first and second waste receptacles press against the inside surface of the first and second side walls, and edges of the wheels of the first and second waste receptacles press against the inside surface of the first and second side walls, and edges of a receptacle part between the wheels and handles of each of the first and second waste receptacles press against the first and second horizontal members.

2. The system as in claim 1, further comprising a pallet base, underlying the floor.

3. The system as in claim 1, further comprising a top surface, extending inward along a top of all of the first side wall, the second side wall and the third side wall, forming a flat surface along all of the first side wall, the second side wall and the third side wall.

4. The system as in claim 3, further comprising flanges, including first and second flanges extending upward from the first and second side walls respectively at a front thereof, and third and fourth flanges extending upward from the first and second side walls at a rear portion thereof.

5. The system as in claim 4, wherein the third and fourth flanges are right angled flanges, where the third flange extends upward from both the first side wall and the third side wall, and the fourth flange extends upward from both the second side wall and the third side wall.

6. The system as in claim 1, wherein the first and second vertical members of said first and second side walls extend toward one another and leave an opening between the first and second vertical members that is smaller than a distance between edges of the handles of the first and second waste receptacles.

7. The system as in claim 1, wherein the first and second vertical members of said first and second side walls extend toward one another and leave an opening between the first and second vertical members that is smaller than a distance between outer surfaces of the wheels of the first and second waste receptacles.

* * * * *